US009060610B2

(12) United States Patent
Thurow

(10) Patent No.: US 9,060,610 B2
(45) Date of Patent: Jun. 23, 2015

(54) SPRING BACK HINGE WITH OR WITHOUT SPRING LOCK MECHANISM

(71) Applicant: FLEXSTEEL METAL DIVISION, Dubuque, IA (US)

(72) Inventor: Jerry Thurow, Dubuque, IA (US)

(73) Assignee: FLEXSTEEL INDUSTRIES, INC., Dubuque, IA (US)

( * ) Notice: Subject to any disclaimer, the term of this patent is extended or adjusted under 35 U.S.C. 154(b) by 0 days.

(21) Appl. No.: 13/675,698

(22) Filed: Nov. 13, 2012

(65) Prior Publication Data

US 2013/0119735 A1 May 16, 2013

Related U.S. Application Data

(60) Provisional application No. 61/558,808, filed on Nov. 11, 2011.

(51) Int. Cl.
*A47C 1/024* (2006.01)
*A47C 7/44* (2006.01)

(52) U.S. Cl.
CPC ..... *A47C 1/024* (2013.01); *A47C 7/441* (2013.01); *A47C 7/443* (2013.01)

(58) Field of Classification Search
CPC ..... A47C 1/024; A47C 7/441; A47C 7/443
USPC ..... 297/301.7, 301.4, 378.12, 285, 291, 297/299, 440.15, 440.2, 303.5
See application file for complete search history.

(56) References Cited

U.S. PATENT DOCUMENTS

| | | | | |
|---|---|---|---|---|
| 2,286,168 | A * | 6/1942 | Hyland et al. | 297/301.4 |
| 2,429,260 | A | 10/1947 | Coopersmith | |
| 4,496,190 | A | 1/1985 | Barley | |
| 4,629,252 | A * | 12/1986 | Myers et al. | 297/366 |
| 5,174,630 | A * | 12/1992 | Cilliere et al. | 297/301.7 |
| 5,498,052 | A | 3/1996 | Severini et al. | |
| 5,511,853 | A | 4/1996 | Wallis | |
| 6,725,473 | B2 | 4/2004 | Grossman et al. | |
| 6,904,628 | B2 | 6/2005 | Murphy et al. | |
| 7,152,925 | B2 * | 12/2006 | Hur et al. | 297/378.13 |
| 7,444,692 | B2 | 11/2008 | Grossman et al. | |
| 7,488,300 | B2 | 2/2009 | Houser | |
| 7,648,206 | B2 * | 1/2010 | Wieclawski | 297/378.12 |
| 7,871,128 | B2 * | 1/2011 | Bonk et al. | 297/378.12 |
| 2002/0135216 | A1 * | 9/2002 | Hamelin et al. | 297/378.12 |
| 2002/0185904 | A1 * | 12/2002 | Carlson et al. | 297/378.12 |
| 2004/0140704 | A1 * | 7/2004 | Abdella et al. | 297/344.11 |
| 2005/0104433 | A1 * | 5/2005 | Ganot et al. | 297/378.12 |
| 2006/0061184 | A1 * | 3/2006 | Jennings | 297/378.12 |
| 2006/0273645 | A1 * | 12/2006 | Ferrari et al. | 297/336 |
| 2011/0095589 | A1 * | 4/2011 | Shao | 297/378.12 |

* cited by examiner

*Primary Examiner* — Jeannette E Chapman
(74) *Attorney, Agent, or Firm* — Ladas & Parry LLP

(57) ABSTRACT

A spring back hinge interconnects a backrest frame to a chair seat frame or is mountable to just the chair base frame, the spring back hinge being optionally fittable with a lever actuated locking assembly and the spring back hinge being fittable on a single side or both sides, alternative back rest frames being fittable to the spring back hinge.

11 Claims, 7 Drawing Sheets

SPRING BACK HINGE WITH OR WITHOUT SPRING LOCK MECHANISM

RELATED APPLICATIONS

This application claims priority based on U.S. Provisional Application Ser. No. 61/558,808 filed Nov. 11, 2001. Additionally, embodiments may utilize a spring arrangement taught in co-pending application Ser. No. 10/595,330, also published as Publication No. 2007-0040311 on Feb. 22, 2007, which disclosures are incorporated by reference as if full set forth herein.

BACKGROUND

Field of Invention

The present technology relates generally to backrest adjustment, and more particularly to a flexible hinge that allows a backrest to rock and a spring lock to allow or inhibit the backrest to rock.

SUMMARY

A spring back hinge with or without a spring lock mechanism is provided for a backrest. The spring back hinge is mounted on a left, right or both left and right side of a backrest frame that and provides spring in the back frame to allow a user to "rock" the backrest fore and aft independent of a fixed seat frame or cushion. The hinge allows for mechanical adjustment of the tension used in the flex of the back frame assembly allowing a softer or firmer "ride" depending on the user's preference. An optional spring-lock spring mechanism provides a means to the user to fix the back position in the normal sitting position by simply moving a lever. The design as a whole can operatively connect standard seat frame units with easily interchangeable back frame and arm rest profiles and also different spring hinge assemblies, which improves adaptability to different styles and configuration of finished furniture with improved performance and reduced number of variable parts.

DETAILED DESCRIPTION

The foregoing drawings and the description below represent a system using a left and right spring back hinge with or without lock. For single side systems, one side would be replaced with a pivoting hinge system.

Figure 1:
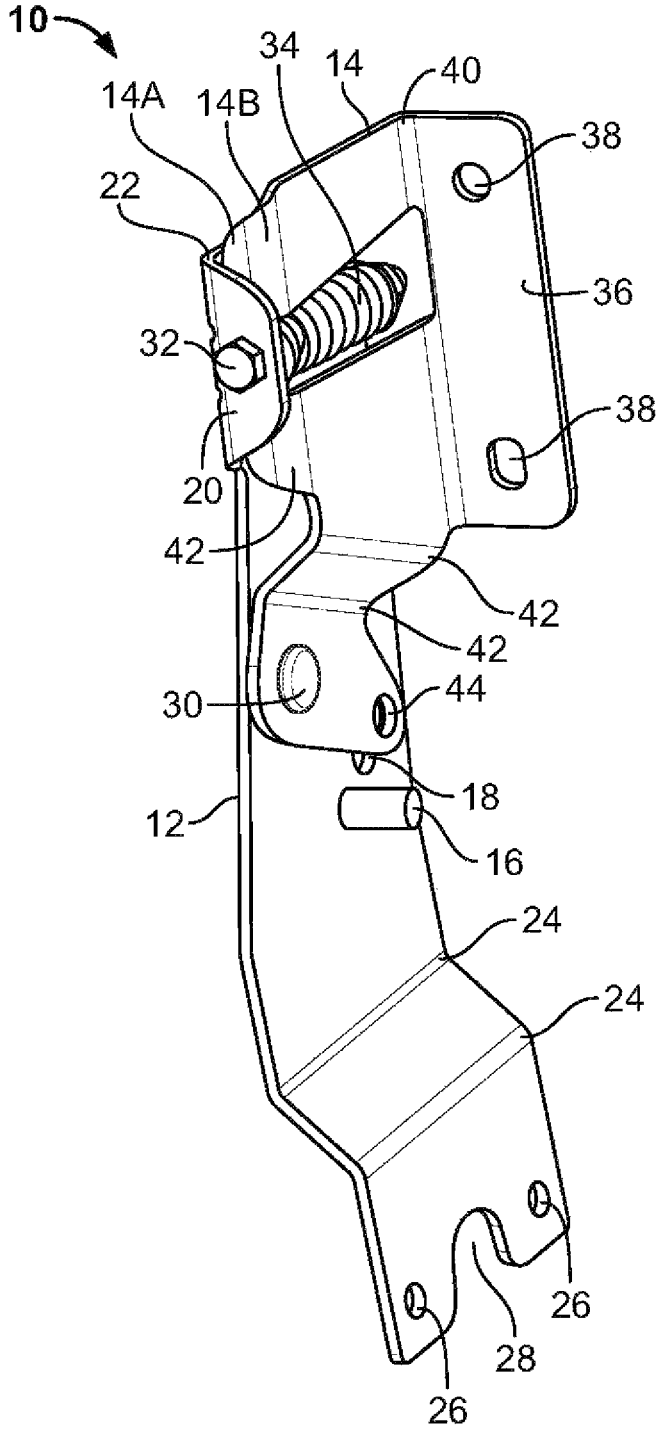
FIG. 1 is an isometric view of a spring back hinge assembly.
Figure 2C:
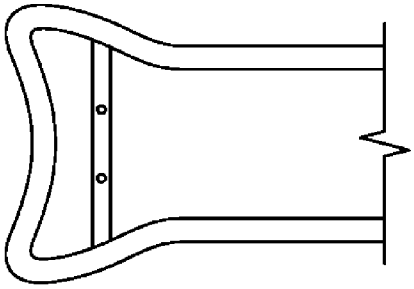
FIG. 2C is a perspective view illustrating an alternative embodiment of seat back.
Figure 2B:
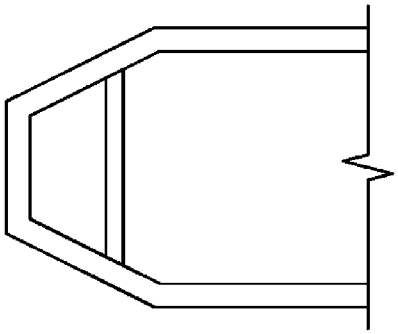
FIG. 2B is a perspective view illustrating an alternative embodiment of seat back.
Figure 2D:
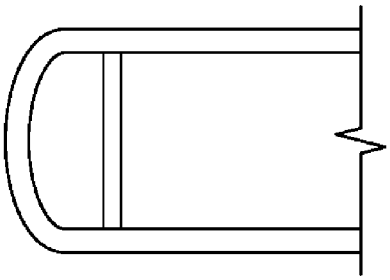
FIG. 2D is a perspective view illustrating an alternative embodiment of seat back.
Figure 2A:
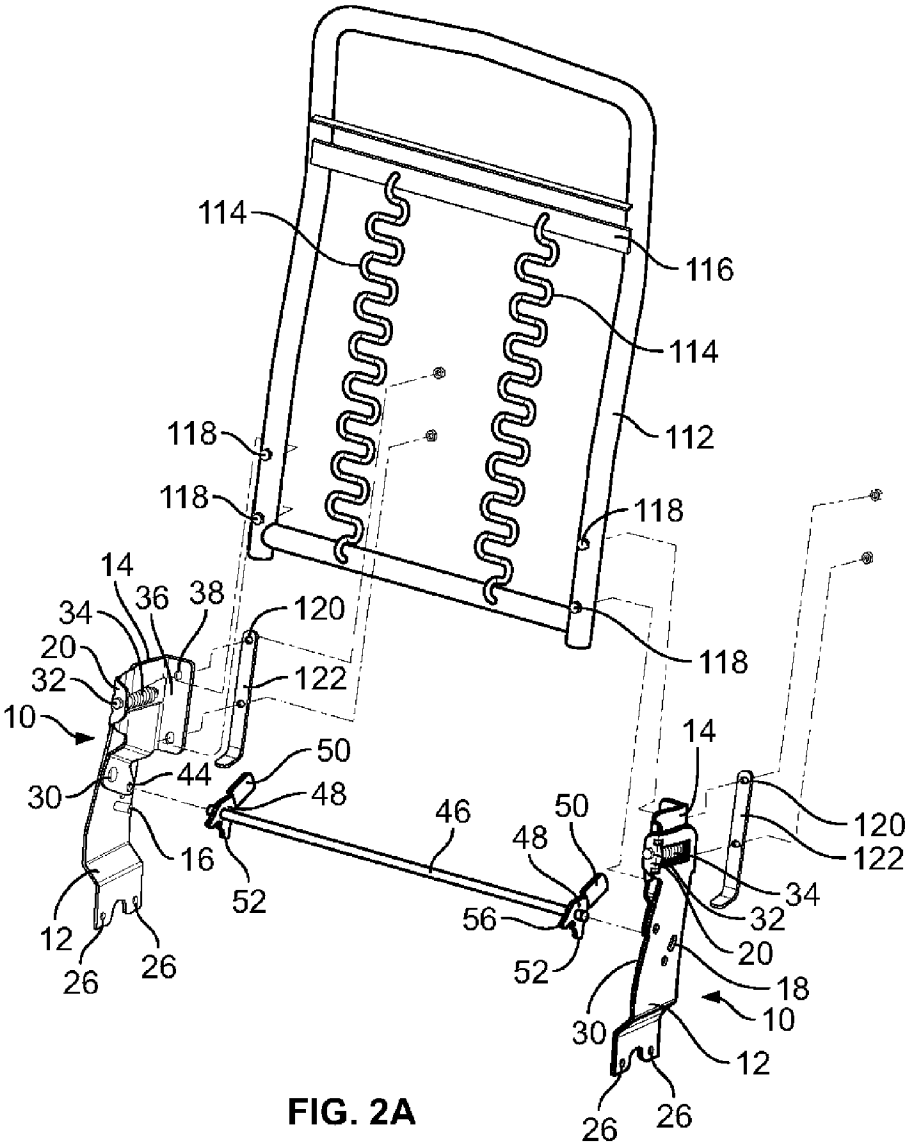
FIG. 2A is an exploded view of the spring back hinge and backrest assembly with optional spring lock mechanism.

Referring now to FIGS. 1 and 2 a spring back hinge assembly 10 is provided. The assembly 10 has a base plate 12 and a hinge plate 14. The base plate 12 has a locking pin 16 and lock rod clearance slot 18. Locking pin 16 allows for the base plate 12 and hinge plate 14 to be locked in a fixed position when an optional spring lock assembly 46 is installed. Locking pin 16 may also act as a motion limit pin which limits rearward travel of the back frame assembly. The base plate 12 contains a spring mounting plate 20. In a preferred embodiment, the spring mounting plate 20 is formed from a bend 22 in the base plate 12. The base plate 12 may also contain bends, such as bends 24, in a preferred embodiment, to conform to the design of a chair frame. Additionally, in a preferred embodiment, the base plate 12 has mounting holes 26 and a recess 28 to allow for mounting to a chair frame. The hinge plate 14 may also contain a spring return plate 14A. In several embodiments, the spring return plate 14A is formed from a bend 14B in hinge plate 14. Lock rod clearance slot 18 may receive a lock rod 48 when lock assembly 46 is installed. Because of the obround shape of slot 18, engagement of lock assembly 46 moves the ends of rod 48 in slot 18 to lock seat back 112.

In FIG. 1, hinge plate 14 is movably connected to base plate 12 with a fastener 30 (for example a bolt, rivet, pin, etc.) to permit rotation of plate 14 relative to plate 12. The fastener 30 is received through a hole in the hinge plate 14 and hole in the base plate 12. The adjustable tension bolt 32 is fixedly received through a hole in the spring mounting plate 20 and slidably received through a hole in the spring return plate 14A. A spring 34 surrounds the adjustable tension bolt 32, which can then be adjusted to increase or decrease the tension on the hinge plate 14. For example, when the bolt 32 is tightened, the spring 34 is compressed, thus increasing the tension in the spring 34 resulting in increased tension in the hinge plate 14 in relation to the base plate 12. When the tension in the spring 34 is increased, more pressure is required from a user to "rock" or recline in the chair or seat.

Hinge plate 14 has a mounting plate 36 with mounting holes 38 to be mounted to a backrest frame 112. In a preferred embodiment, the mounting plate 36 is formed from a bend 40 in the hinge plate 14. The hinge plate 14 may also contain bends, such as bends 42, in a preferred embodiment to conform to the design of a chair frame or backrest frame 112. Hinge plate 14 also contains a lock mechanism receiving hole 44 for receiving a lock assembly 46.

Referring now to FIG. 2, an exploded view of the assembly 10 and how it connects with a backrest frame 112 is provided. In the provided embodiment, the backrest frame 112 is a substantially rectangular structure with sinuous springs 114 extending between a frame cross member 116. In a preferred embodiment, the sinuous springs 114 are generally parallel to the chair base frame 110 (shown in FIGS. 3-5*a*), although other types of springs may provide equivalent functionality. FIG. 2 preferred embodiment shows the lock assembly 46 having a lock rod 48 locking plate 52 fixed to lock rod 48 and having a lever handle 50 and locking arm 54 and locking cam 56. Alternately locking plate 52 and handle 50 can be located on one side of lock rod 48 only. Backrest frame 112 has mounting holes for receiving mounting bolts 118. Mounting bolts 118 are received by the mounting holes 38 of the mounting plate 36, thereby fixing the hinge plate 14 to the backrest frame 112. Additionally, mounting bolts 118 are received by mounting holes 120 in spring steel straps 122 with optional spring lock 46. Spring steel straps 122 are 'L' shaped and apply pressure to the lock rod 48 to maintain a locked or unlocked position of the locking levers 50. FIG. 2A, FIG. 2B and FIG. 2C illustrate variations in backrest frame 112 outside shape, which may be used as alternatives to provide selected appearance to a finished, upholstered chair or seat. The independent operation of spring assembly 10 permits this adaptation, while keeping the other components the same.

Figure 3:
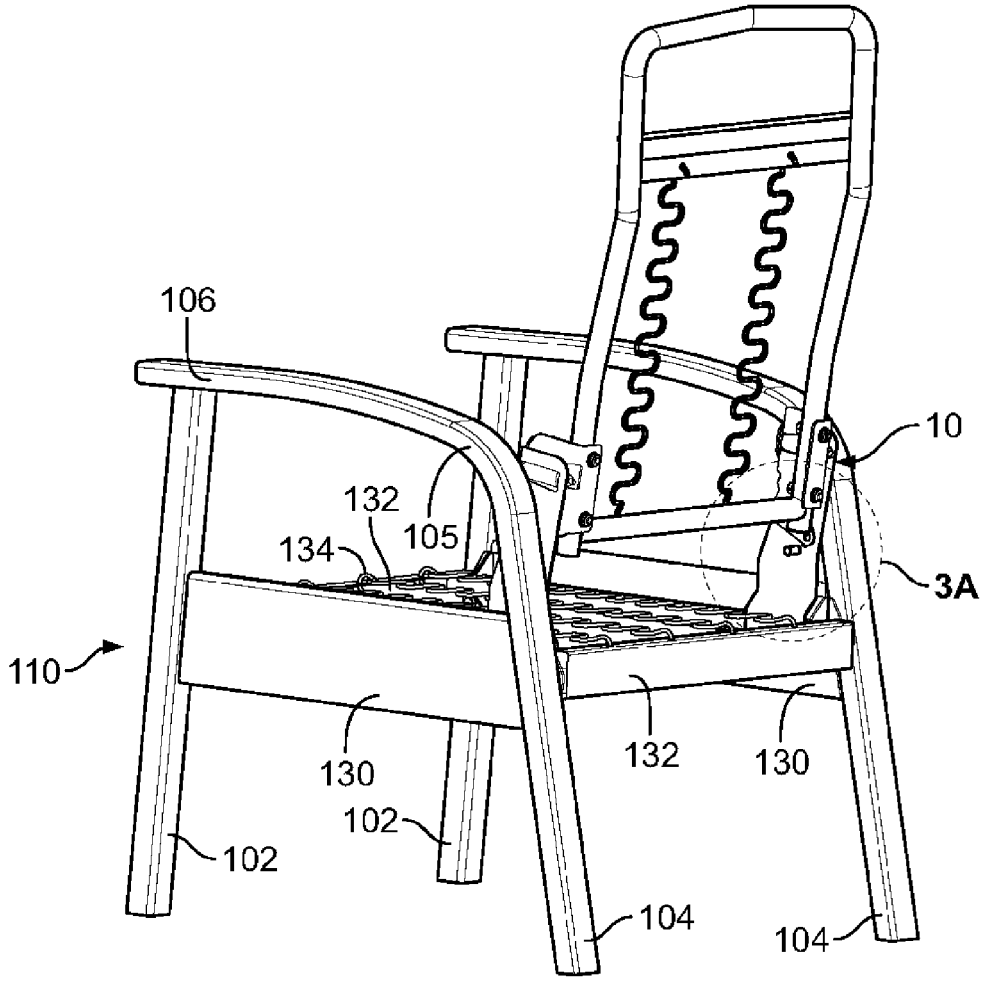
FIG. 3 is an isometric view of another embodiment of a seat assembly with a spring back hinge and without a lock mechanism.

Referring now to FIG. 3, an exemplary embodiment of a chair or seat is shown with spring hinge assembly 10. The chair or seat is made up of legs 102 and 104, armrests 106, chair base frame 110, and backrest frame 112. Other chair and seating designs, for example different types of bases, number of legs, or types of backrests, movable chairs, or mounted seats, in a variety of uses, such as furniture in or associated with buildings or outdoors, or seating in vehicles, have been considered. In one embodiment, two spring hinge assemblies 10 are attached via the base plates 12 of the assemblies 10 to the base frame 110, and a backrest frame 112 is mounted to the hinge plates 14 of the assemblies 10. Another embodiment is for the spring hinge 10 to be attached to arm assembly 136.

Chair base frame 110 as shown is a leg assembly which can be individually attached to a seat frame unit consisting of side rails and front and rear frame end members 132, without or without springs. In this embodiment, sinuous springs 134 are stretched between the frame end members 132, although other spring types could be considered. Also shown in a preferred embodiment are the armrests 106 and rear legs being formed from one continuous member 105, and with additional side members 130 attached although other commonly known designs are considered.

Figure 3A:
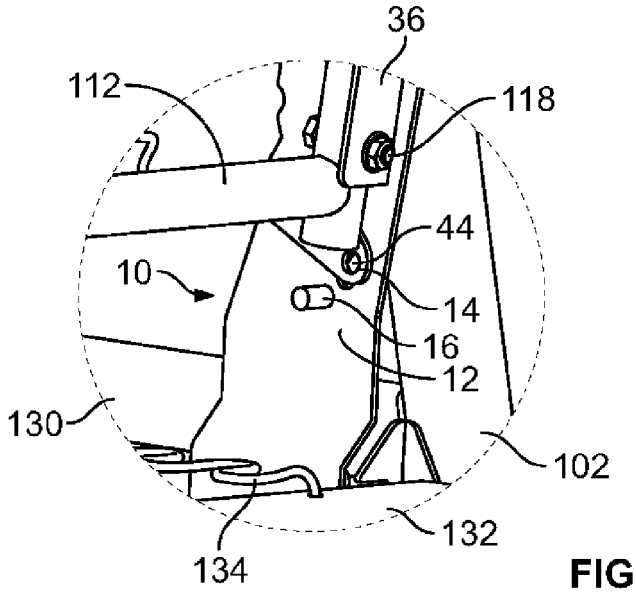
FIG. 3A is a detailed isometric view of the installed spring back hinge without a lock mechanism.

FIGS. 3 and 3*a* are shown without an optional lock assembly. Specifically referring to FIG. 3*a*, which is taken from cutout "3A" of FIG. 3, the lock assembly receiving hole 44 does not include the lock rod 48 of the lock assembly 46.

Figure 4:
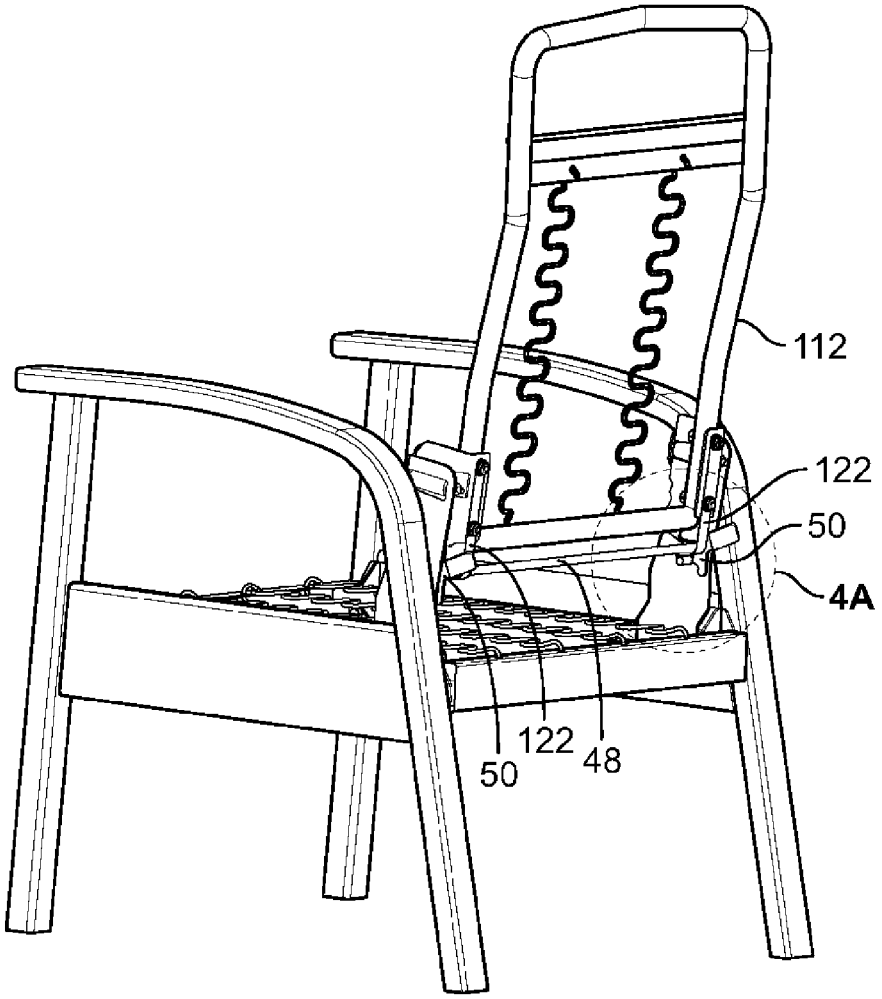
FIG. 4 is an isometric view of a third embodiment of a seat assembly with a spring back hinge and a lock mechanism in the unlocked position.
Figure 4A:
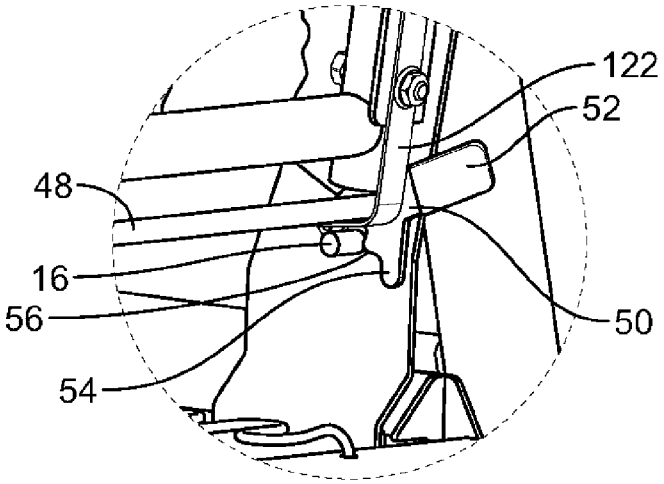
FIG. 4A is a detailed isometric view of the installed spring back hinge with a lock mechanism in the unlocked position.

Referring now to FIGS. 4 and 4*a*, an exemplary embodiment of a chair or seat as shown in FIG. 3 is provided along with the lock assembly 46. The spring back hinge assemblies 10 in this embodiment are mounted to the seat frame unit 132, and the backrest frame 112 is mounted to the assemblies 10 as described above. FIGS. 4 and 4*a* show the lock assembly 46 in the unlock position. Specifically referring to FIG. 4*a*, which is taken from cutout "4A" of FIG. 4, while in the unlock position, the lever handles 52 are in an upward position, and thus locking cam 56 is below locking pin 16 and the locking arms 54 will not contact or engage with the locking pins 16 when a user leans against the backrest frame 112. Therefore, with the lock assembly 46 in this position, the user can freely "rock" or recline backwards while sitting in the chair, within the mechanical limits of the apparatus. As mentioned above, the spring steel strap 122 provides pressure to the lock rod 48 in order to keep the lock assembly 46 in the unlock (upward) position. Lock assembly is maintained in this position by spring steel straps 122. Spring steel straps 122 are 'L' shaped and apply pressure to the lock rod 48 to maintain a locked or unlocked position of the locking levers 50. Moving lever handle 52 engages cam and displaces spring strap 122 until the area between cam 56 and arm 54 engages pin 16, as shown in FIG. 5 and FIG. 5A.

Figure 5:
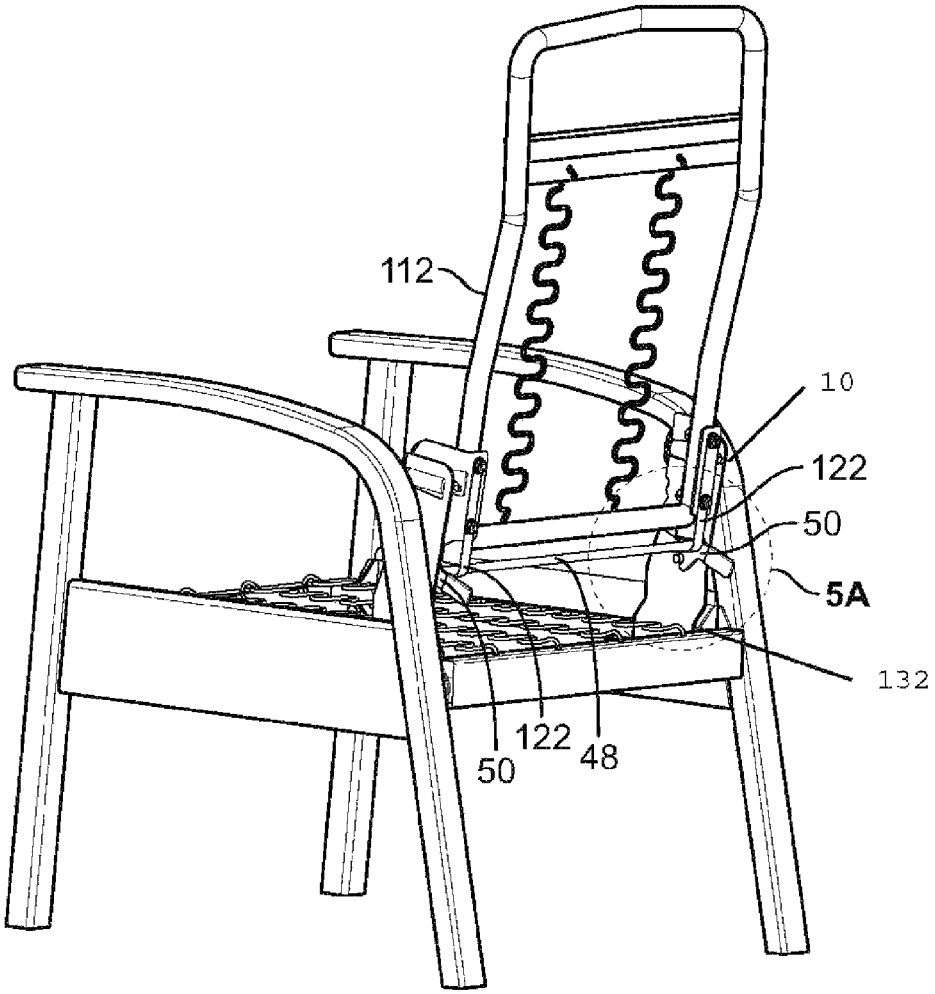
FIG. 5 is an isometric view of a fourth embodiment of a seat assembly with a spring back hinge and a lock mechanism in the locked position.
Figure 5A:
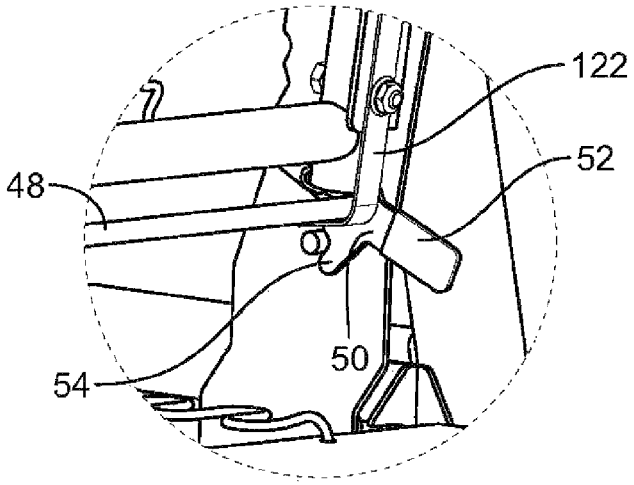
FIG. 5A is a detailed isometric view of the installed spring back hinge with a lock mechanism in the locked position.

Referring now to FIGS. 5 and 5*a*, an exemplary embodiment of a chair as shown in FIGS. 3 and 4 is provided with the lock assembly 46 in the lock position. As stated above, in this embodiment the spring back hinge assemblies 10 are mounted to the seat frame 132, and the backrest frame 112 is mounted to the assemblies 10. This, therefore, permits mounting and rotation independently of armrests 106 and is particularly well adapted to structures that have different chair frames, such as wooden or arm-less chair frames. FIGS. 5 and 5*a* show the lock assembly 46 in a locked position. Specifically referring to FIG. 5*a*, which is taken from cutout "5A" of FIG. 5, when lever handle 52 is placed in a locked position (such as in a downward position) being moved against spring steel strap 122 and then held in engagement by spring steel strap 122, locking arm 54 will prevent the backrest frame 112 from rocking by bracing against locking pin 16. Therefore, when a user leans back against the backrest frame 112, the locking arm 54 will immediately engage the locking pin 16 and prevent the backrest frame 112 from "rocking" or reclining.

Figure 6:
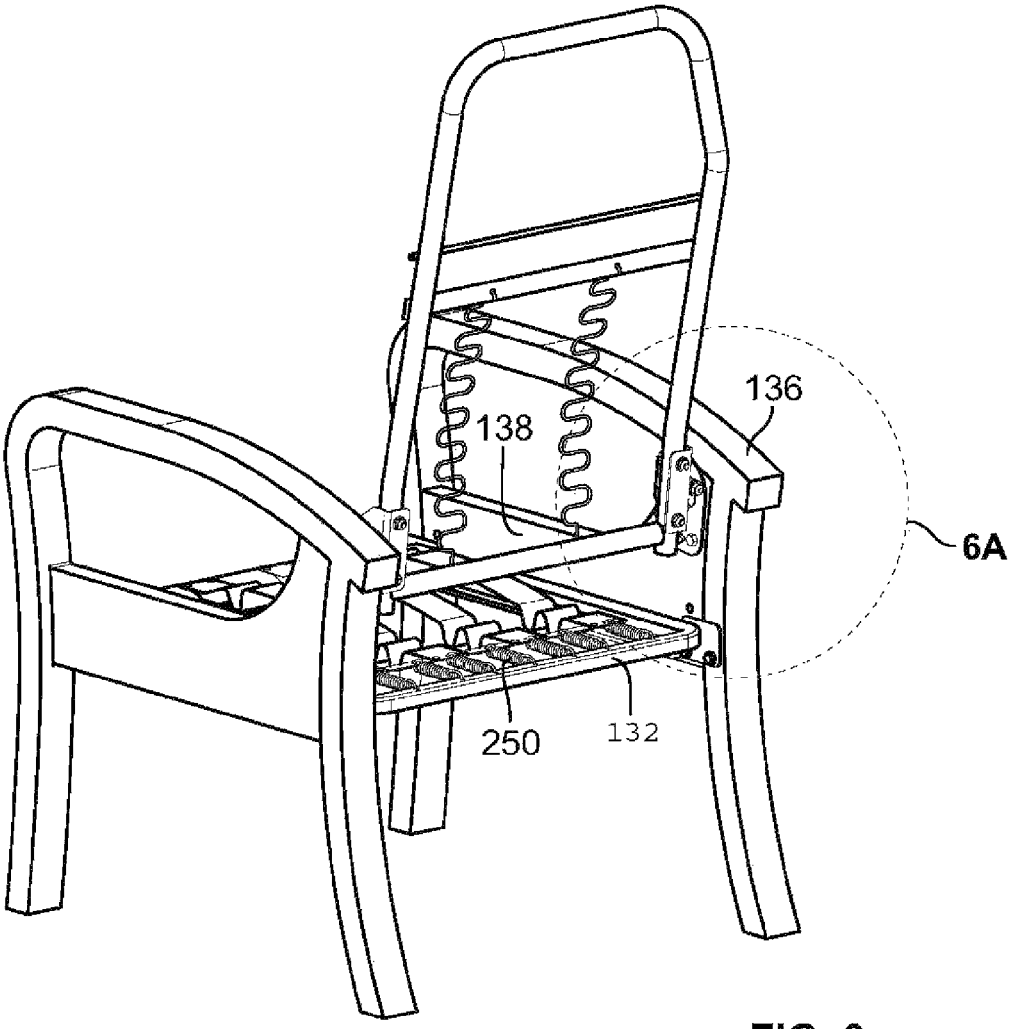
FIG. 6 is an isometric view of a fifth embodiment of a seat assembly with a spring back hinge mounted to a chair frame.
Figure 6A:
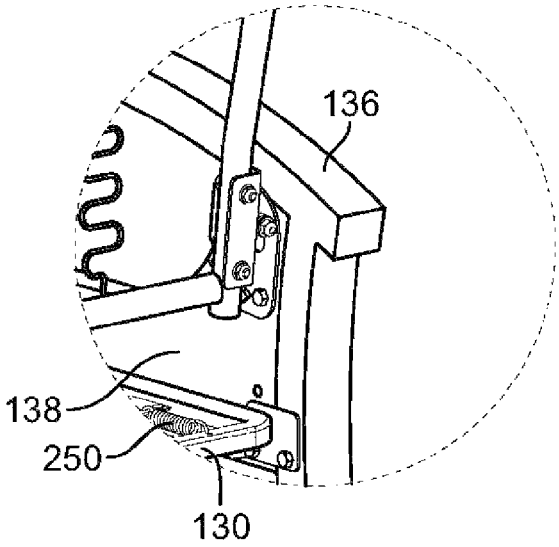
FIG. 6A is a detailed isometric view of the installed spring back hinge mounted to a chair frame.
Figure 7:
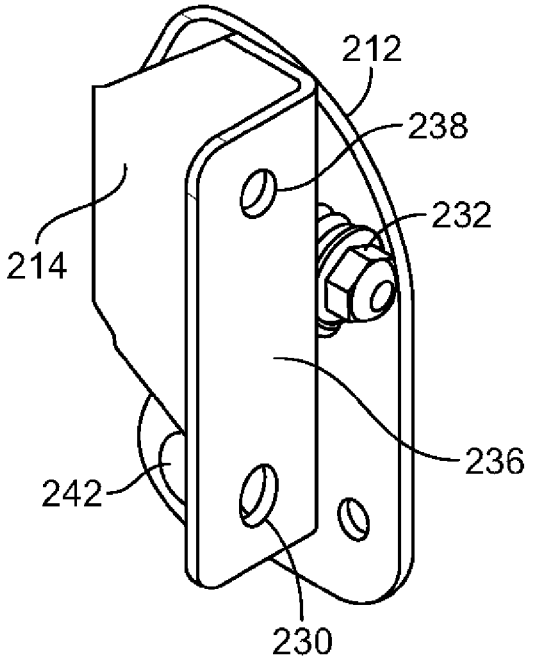
FIG. 7 is a perspective view of the installed spring back hinge of FIGS. 6 and 6A.
Figure 8:
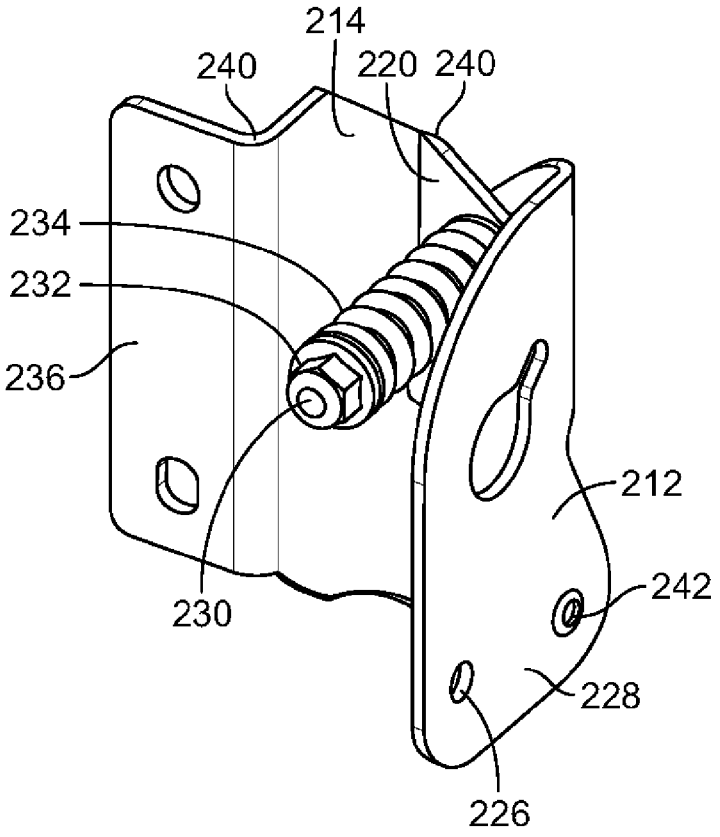
FIG. 8 is a perspective view of the installed spring back hinge of FIGS. 6 and 6A from an angle rotated from that of FIG. 7.

FIG. 6 and FIG. 6A show an embodiment in which the spring hinge 10 is attached to arm assembly 136. Arm assembly 136 includes a plate or web 138 that interconnects the arm and leg portions into a structural unit. In this embodiment In FIG. 7 and FIG. 8 hinge plate 214 is movably connected to base plate 212 with a fastener 230 (for example a bolt, stud, rivet, pin, etc.) which may be adapted to receive an adjustable tension nut 232. The fastener 230 is fixedly mounted to the base plate 212 and passes through the hinge plate 214 so as to permit the relative motion, as restrained by spring 234. In particular, fastener 230 passes through the seat back mounting plate flange 220 of plate 214 such as through an aperture. A spring 234 surrounds the fastener 230 and compressed by adjustable tension nut 232, which can then be adjusted to increase or decrease the tension on the plate 214. For example, when the nut 232 is tightened, the spring 234 is compressed, thus increasing the tension in the spring 234 resulting in increased tension in the hinge plate 214 in relation to the base plate 212. When the tension in the spring 234 is increased, more pressure is required from a user to "rock" or recline in the chair.

Hinge plate 214 has a mounting plate 236 with mounting holes 238 to be fastened mounted to a backrest frame 112. In a preferred embodiment, the mounting plate 236 is formed by two bends 240 in the hinge plate 214. Base plate 212 has hole 226 in mounting flange 228 for mounting to plate 138 or such other suitable gusset, flange or structure. Frame 112 mounted to plate 236 rotates around pin 242 to permit movement, which movement compresses spring 234 as frame 112 is moved or rocked by a user of the seating device. This arrangement permits back frame 112 to be mounted and move independently of seat frame unit 132.

Also seen in FIG. 6, seat frame unit 132 has been preferably been replaced by a double spring function leaf spring and coil spring seat frame unit 250. Seat frame unit 250 is taught in co-pending application Ser. No. 10/595,330, also published as US Publication No. 2007-0040311 on Feb. 22, 2007, which disclosures are incorporated by reference as if full set forth herein.

Numerous modifications to the features described and shown are possible. Accordingly the described and illustrated embodiments are to be construed as merely exemplary of the inventive concepts expressed herein.

In accordance with the invention, applicant claims:

1. A spring back hinge mounted on sitting structure comprising:

said sitting structure having a side and floor supporting member;

said sitting structure having a seat frame and a backrest;

said sitting structure having a left side and a right side;

said spring back hinge being mounted to one of said left side or said right side, or mounted to both said left and right sides structure;

said spring back hinge being mounted so as to allow a user to rock said backrest fore and aft independently of moving said seat frame;

said spring back hinge being adapted to allow for mechanical adjustment of the tension used in the flex of the back frame, thereby allowing a softer or firmer ride depending on the user's preference;

said spring back hinge including a spring-lock spring mechanism adapted to fix the back position by engaging a lever, whereby the seat back hinge can operatively connect standard seat frame units with interchangeable back frames;

said sitting structure includes a chair base frame;

said spring back hinge is attached to said chair base frame;

said chair base frame has arm and leg portions and includes a plate or web that interconnects said arm and leg portions into a structural unit;

said spring back hinge being formed with a hinge plate and a base plate;

said hinge plate has a seat back mounting plate flange;

said hinge plate is pivotally attached to said base plate;

said hinge plate is movably connected to base plate with a fastener and spring whereby the fastener is fixed to said base plate and passes through the seat back mounting plate flange while the spring bears on said flange to provide resistance to rocking;

a spring surrounds said fastener and is compressible by adjustment of a tension member, which tension member can then be adjusted to increase or decrease the tension on the hinge plate;

said seating unit is provided with a lock assembly;

said lock assembly has a lock plate formed to define a lever handle, a locking cam and a locking arm with a pin receiving area between said cam and said arm;

said plate being rotatably mounted on a lock rod;

said lock rod is rotatably and slidably mounted in said base plate;

a locking pin being fixed in said supporting member;

a spring strap holding said lock assembly in a selected position;

said lock plate is rotatable against said spring strap between an unlocked position in which said pin is unengaged and a locked position in which said pin receiving area engages said pin;

said backrest is attached to said spring back hinge with mounting bolts;

said mounting bolts additionally mounting said spring straps;

said spring straps are 'L' shaped with the long arm of the "L" being mounted and the shorter arm of the "L" capturing said lock rod to maintain a locked or unlocked position of the locking plate;

said seating structure is made up of a chair base frame acting to support a seat frame and a backrest frame;

two spring hinge assemblies are attached via said base plates to said seat frame;

said backrest frame is mounted to said hinge plates said spring back hinge is mounted to said chair base frame.

2. A spring back hinge mounted on sitting structure comprising:

said sitting structure having a side and floor supporting member;

said sitting structure having a seat frame and a backrest;

said sitting structure having a left side and a right side;

said spring back hinge being mounted to one of said left side or said right side, or mounted to both said left and right sides structure;

said spring back hinge mounted so as to allow a user to rock said backrest fore and aft independently of moving said seat frame;

said spring back hinge being adapted to allow for mechanical adjustment of the tension used in the flex of the back frame, thereby allowing a softer or firmer ride depending on the user's preference;

said spring back hinge including a spring-lock spring mechanism adapted to fix the back position by engaging a lever, whereby the seat back hinge can operatively connect standard seat frame units with interchangeable back frames;

said sitting structure includes a chair base frame;

said spring back hinge is attached to said chair base frame said chair base frame has arm and leg portions and includes a plate or web that interconnects said arm and leg portions into a structural unit said spring back hinge being formed with a hinge plate and a base plate;

said hinge plate has a seat back mounting plate flange;

said hinge plate is pivotally attached to said base plate;

said hinge plate is movably connected to base plate with a fastener and spring whereby the fastener is fixed to said base plate and passes through the seat back mounting plate flange while the spring bears on said flange to provide resistance to rocking;

a spring surrounds said fastener and is compressible by adjustment of a tension member, which tension member can then be adjusted to increase or decrease the tension on the hinge plate.

3. The spring back hinge in accordance with claim 2 further comprising:

a mounting plate is formed from a bend in said the hinge plate;

said hinge plate is also formed to mate with and be mountable to said backrest frame said hinge plate is formed to have a lock mechanism receiving hole for receiving a lock assembly.

4. The spring back hinge of claim 3 further comprising:

said seating structure is made up of a chair base frame with legs and armrests coacting to support a seat frame, and a backrest frame;

two spring hinge assemblies are attached via said base plates to said seat frame;

said backrest frame is mounted to said hinge plates said spring back hinge is mounted to interconnect said chair base frame and said seat frame.

5. The spring back hinge of claim 3 further comprising:

said seating structure is made up of a chair base frame acting to support a seat frame and a backrest frame;

two spring hinge assemblies are attached via said base plates to said seat frame;

said backrest frame is mounted to said hinge plates said spring back hinge is mounted to said chair base frame.

6. A spring back hinge mounted on sitting structure comprising:

said sitting structure having a side and floor supporting member;

said sitting structure having a seat frame and a backrest;

said sitting structure having a left side and a right side;

said spring back hinge being mounted to one of said left side or said right side, or mounted to both said left and right sides structure;

said spring back hinge mounted so as to allow a user to rock said backrest fore and aft independently of moving said seat frame;

said spring back hinge being adapted to allow for mechanical adjustment of the tension used in the flex of the back frame, thereby allowing a softer or firmer ride depending on the user's preference;

said spring back hinge including a spring-lock spring mechanism adapted to fix the back position by engaging a lever, whereby the seat back hinge can operatively connect standard seat frame units with interchangeable back frames;

said seating unit is provided with a lock assembly;

said lock assembly has a lock plate formed to define a lever handle, a locking cam and a locking arm with a pin receiving area between said cam and said arm;

said plate being rotatably mounted on a lock rod;

said lock rod is rotatably and slidably mounted in said base plate;

a locking pin being fixed in said supporting member;

a spring strap holding said lock assembly in a selected position;

said lock plate is rotatable against said spring strap between an unlocked position in which said pin is unengaged and a locked position in which said pin receiving area engages said pin.

7. The locking assembly of claim 6 further comprising:

said backrest is attached to said spring back hinge with mounting bolts;

said mounting bolts additionally mounting said spring straps;

said spring straps are 'L' shaped with the long arm of the "L" being mounted and the shorter arm of the "L" capturing said lock rod to maintain a locked or unlocked position of the locking plate.

8. A spring back hinge mounted on sitting structure comprising:

said sitting structure having a side and floor supporting member;

said sitting structure having a seat frame and a backrest;

said sitting structure having a left side and a right side;

said spring back hinge being mounted to one of said left side or said right side, or mounted to both said left and right sides structure;

said spring back hinge being mounted so as to allow a user to rock said backrest fore and aft independently of moving said seat frame;

said spring back hinge being adapted to allow for mechanical adjustment of the tension used in the flex of the back frame, thereby allowing a softer or firmer ride depending on the user's preference;

said spring back hinge including a spring-lock spring mechanism adapted to fix the back position by engaging a lever, whereby the seat back hinge can operatively connect standard seat frame units with interchangeable back frames;

said sitting structure includes a chair base frame;

said spring back hinge is attached to said chair base frame;

said chair base frame has arm and leg portions and includes a plate or web that interconnects said arm and leg portions into a structural unit;

said spring back hinge being formed with a hinge plate and a base plate;

said hinge plate has a seat back mounting plate flange;

said hinge plate is pivotally attached to said base plate;

said hinge plate is movably connected to base plate with a fastener and spring whereby the fastener is fixed to said base plate and passes through the seat back mounting plate flange while the spring bears on said flange to provide resistance to rocking;

a spring surrounds said fastener and is compressible by adjustment of a tension member, which tension member can then be adjusted to increase or decrease the tension on the hinge plate.

9. The spring back hinge of claim 8 further comprising;

said seating unit is provided with a lock assembly;

said lock assembly has a lock plate formed to define a lever handle, a locking cam and a locking arm with a pin receiving area between said cam and said arm;

said plate being rotatably mounted on a lock rod;

said lock rod is rotatably and slidably mounted in said base plate;

a locking pin being fixed in said supporting member;

a spring strap holding said lock assembly in a selected position;

said lock plate is rotatable against said spring strap between an unlocked position in which said pin is unengaged and a locked position in which said pin receiving area engages said pin;

said backrest is attached to said spring back hinge with mounting bolts;

said mounting bolts additionally mounting said spring straps.

10. The spring back hinge of claim 9 further comprising;

said spring straps are 'L' shaped with the long arm of the "L" being mounted and the shorter arm of the "L" capturing said lock rod to maintain a locked or unlocked position of the locking plate.

11. The spring back hinge of claim 10 further comprising;

said seating structure is made up of a chair base frame acting to support a seat frame and a backrest frame;

two spring hinge assemblies are attached via said base plates to said seat frame;

said backrest frame is mounted to said hinge plates said spring back hinge is mounted to said chair base frame.

* * * * *